US009799951B2

(12) United States Patent
Sawaya et al.

(10) Patent No.: US 9,799,951 B2
(45) Date of Patent: Oct. 24, 2017

(54) ANTENNA UNIT

(75) Inventors: Takuma Sawaya, Aichi (JP); Tokumitsu Hanita, Aichi (JP); Seiji Go, Gunma (JP); Atsushi Ubukata, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 487 days.

(21) Appl. No.: 13/877,698

(22) PCT Filed: Aug. 31, 2011

(86) PCT No.: PCT/JP2011/069789

§ 371 (c)(1),
(2), (4) Date: Jun. 12, 2013

(87) PCT Pub. No.: WO2012/046524

PCT Pub. Date: Apr. 12, 2012

(65) Prior Publication Data

US 2013/0265208 A1 Oct. 10, 2013

(30) Foreign Application Priority Data

Oct. 8, 2010 (JP) ..... 2010-228551

(51) Int. Cl.
*H01Q 1/42* (2006.01)
*H01Q 1/32* (2006.01)

(52) U.S. Cl.
CPC ..... *H01Q 1/422* (2013.01); *H01Q 1/3275* (2013.01); *H01Q 1/42* (2013.01)

(58) Field of Classification Search
CPC ..... H01Q 1/42; H01Q 1/422; H01Q 1/3275
USPC ..... 343/703, 894, 760, 872, 873, 713
See application file for complete search history.

(56) References Cited

U.S. PATENT DOCUMENTS

| | | | | |
|---|---|---|---|---|
| 5,757,327 | A * | 5/1998 | Yajima | H01Q 21/061 343/700 MS |
| 7,088,297 | B2 * | 8/2006 | Nakano et al. | 343/713 |
| 7,414,588 | B2 * | 8/2008 | Tateno | 343/713 |
| 7,429,958 | B2 * | 9/2008 | Lindackers et al. | 343/713 |
| 7,436,367 | B2 * | 10/2008 | Blickle | 343/713 |
| 7,580,002 | B2 * | 8/2009 | Noro | 343/872 |
| 2002/0180643 | A1 * | 12/2002 | Skladany | H01Q 1/32 343/700 MS |
| 2006/0273968 | A1 * | 12/2006 | Noro | H01Q 1/42 343/713 |

(Continued)

FOREIGN PATENT DOCUMENTS

| | | |
|---|---|---|
| JP | 10-247809 A | 9/1998 |
| JP | 2008-182663 A | 8/2008 |
| JP | 2010-147777 A | 7/2010 |

OTHER PUBLICATIONS

Japanese Patent Office International Search Report in International Patent Application No. PCT/JP2011/069789 (dated Oct. 25, 2011).

*Primary Examiner* — Jessica Han
*Assistant Examiner* — Bamidele A Jegede
(74) *Attorney, Agent, or Firm* — Leydig Voit and Mayer

(57) ABSTRACT

An antenna unit includes a base having a base-side fitting portion, antenna elements disposed on the base, an inner case fixed to the base and covering the antenna elements, and an outer case mounted on the base covering the inner case. The outer case 50 has an outer-case-side fitting portion fitted to the base-side fitting portion.

18 Claims, 7 Drawing Sheets

(56) References Cited

U.S. PATENT DOCUMENTS

| | | | | |
|---|---|---|---|---|
| 2007/0031198 | A1* | 2/2007 | Silva | H01Q 1/3275 405/295 |
| 2007/0229374 | A1 | 10/2007 | Shimura | |
| 2008/0111752 | A1* | 5/2008 | Lindackers | H01Q 1/3275 343/713 |
| 2008/0122708 | A1 | 5/2008 | Lindackers et al. | |
| 2009/0066593 | A1* | 3/2009 | Jared | H01Q 1/1214 343/713 |
| 2009/0201216 | A1* | 8/2009 | Gerneth | H01Q 1/002 343/872 |
| 2010/0012724 | A1* | 1/2010 | Yang | G06F 21/78 235/449 |
| 2010/0090923 | A1* | 4/2010 | Sato | H01Q 1/42 343/872 |
| 2010/0134381 | A1 | 6/2010 | Sato | |
| 2010/0245188 | A1* | 9/2010 | Suzuki | H01Q 1/3266 343/713 |

* cited by examiner

ANTENNA UNIT

TECHNICAL FIELD

The present invention relates to an antenna unit suitable for application in which the antenna unit is disposed on a roof of an automobile body etc.

BACKGROUND ART

On-board antenna units disposed on vehicle body roofs are broadly classified into a single case structure and a double case structure.

The single case structure has one case fulfilling both a waterproof function for an antenna element and a function as a painted exterior case. In this case, the case must be painted in accordance with a paint color of a vehicle and the number of antenna units corresponding to the number of set colors of the vehicle must be stored as stock in a factory, putting pressure on a storage space of a manufacturing line.

The double case structure is a structure having an inner case covering an antenna element and an outer case painted in a color matching a paint color of a vehicle. In the double case structure, only the outer cases need to be prepared in accordance with the number of set colors of the vehicle.

Antenna units having the double case structure is disclosed in following Patent Documents 1 and 2.

PRIOR ART DOCUMENTS

Patent Documents

Patent Document 1: Japanese Patent Publication No. 4235194 Patent Document 2: U.S. Pat. No. 7,429,958

Both Patent Documents 1 and 2 describe a structure in which an outer case acting as an exterior is fitted to and mounted on the outside of an inner case attached onto an antenna base. Therefore, considering a gap between the outer case and a vehicle body roof acting as a mounted surface on which the antenna unit is mounted, an accumulated tolerance of a dimension tolerance of the inner case and a dimension tolerance of the outer case affects variation of gap between the outer case and the roof.

SUMMARY OF THE INVENTION

Problems to be Solved by the Invention

In the configuration in which an outer case acting as an exterior is fitted to and mounted on the outside of an inner case as described above, an accumulated tolerance of a dimension tolerance of the inner case and a dimension tolerance of the outer case affects variation of gap between a roof acting as a mounted surface and the outer case and, if the accumulated tolerance is larger, a gap between the roof and the outer case may be no longer negligible.

The present invention was conceived in view of the situations and it is therefore an object of the present invention to provide an antenna unit capable of reducing variation of gap between an outer case and a mounted surface by a structure in which the outer case acting as an exterior is directly attached to a base with an inner case attached.

Another object of the present invention is to provide an antenna unit having a structure in which the outer case can certainly be fitted to the base and hardly comes off.

Means for Solving the Problems

In an aspect of the present invention, an antenna unit includes a base, an antenna element disposed on the base, an inner case fixed to the base to cover the antenna element, and an outer case mounted on the base to cover the inner case.

The base may integrally have a base-side fitting portion while the outer case may integrally have an outer-case-side fitting portion. The outer-case-side fitting portion may be positioned on the inside of an inner wall surface of the outer case across a space and may be fitted to the base-side fitting portion.

The base-side fitting portion may have an engaging protruding portion at a tip of a standing portion rising from a bottom surface portion of the base. The outer-case-side fitting portion may have a main piece portion extending downward from an inner wall surface of the outer case and a sub-piece portion connected at a lower end to the main piece portion. The lower end may act as a supporting point when the sub-piece portion is bent. An upper end of the sub-piece portion may have an engaging claw protruding to the lateral side of the main piece portion. The engaging claw may be engaged by the engaging protruding portion.

The sub-piece portion may be formed inside an opening disposed in the main piece portion.

The base may have a regulating portion facing the standing portion with the outer-case-side fitting portion interposed therebetween. The regulating portion may be located at a position limiting a bending amount of the main piece portion. An upper part of the standing portion and an upper part of the regulating portion may have respective taper surfaces so that a thickness increase toward the lower side.

The base-side fitting portion and the outer-case-side fitting portion may be disposed at each of two locations on a first straight line as well as at each of two locations on a second straight line orthogonal to the first straight line.

The outer case may have a projecting piece portion extending inward from the inner wall surface. The outer case may be rotated by a predetermined angle relative to the base to press the projecting piece portion against an under surface side of the base.

The base may have a feeding cylindrical portion projecting from an under surface and may be fixed to a mounted surface with a first seal member interposed therebetween and surrounding the feeding cylindrical portion.

The inner case may be fixed to the base with a second seal member interposed therebetween and surrounding a disposition space of the antenna element on the base.

It is to be noted that any arbitrary combination of the above-described structural components as well as the expressions according to the present invention changed among a system and so forth are all effective as and encompassed by the present aspects.

Effect of the Invention

Since the antenna unit according to the present invention has the configuration in which the outer case acting as the exterior is directly attached to the base with the inner case attached, variation of gap between the outer case and the mounted surface can be reduced and the gap can substantially be eliminated or can be controlled to a negligible size.

And, even in the case of the configuration in which the outer case is fitted to the base, the outer case can certainly be fitted to the base and the outer case can be prevented from easily coming off due to vibration, shock, etc.

EMBODIMENT FOR CARRYING OUT THE INVENTION

Figure 1:
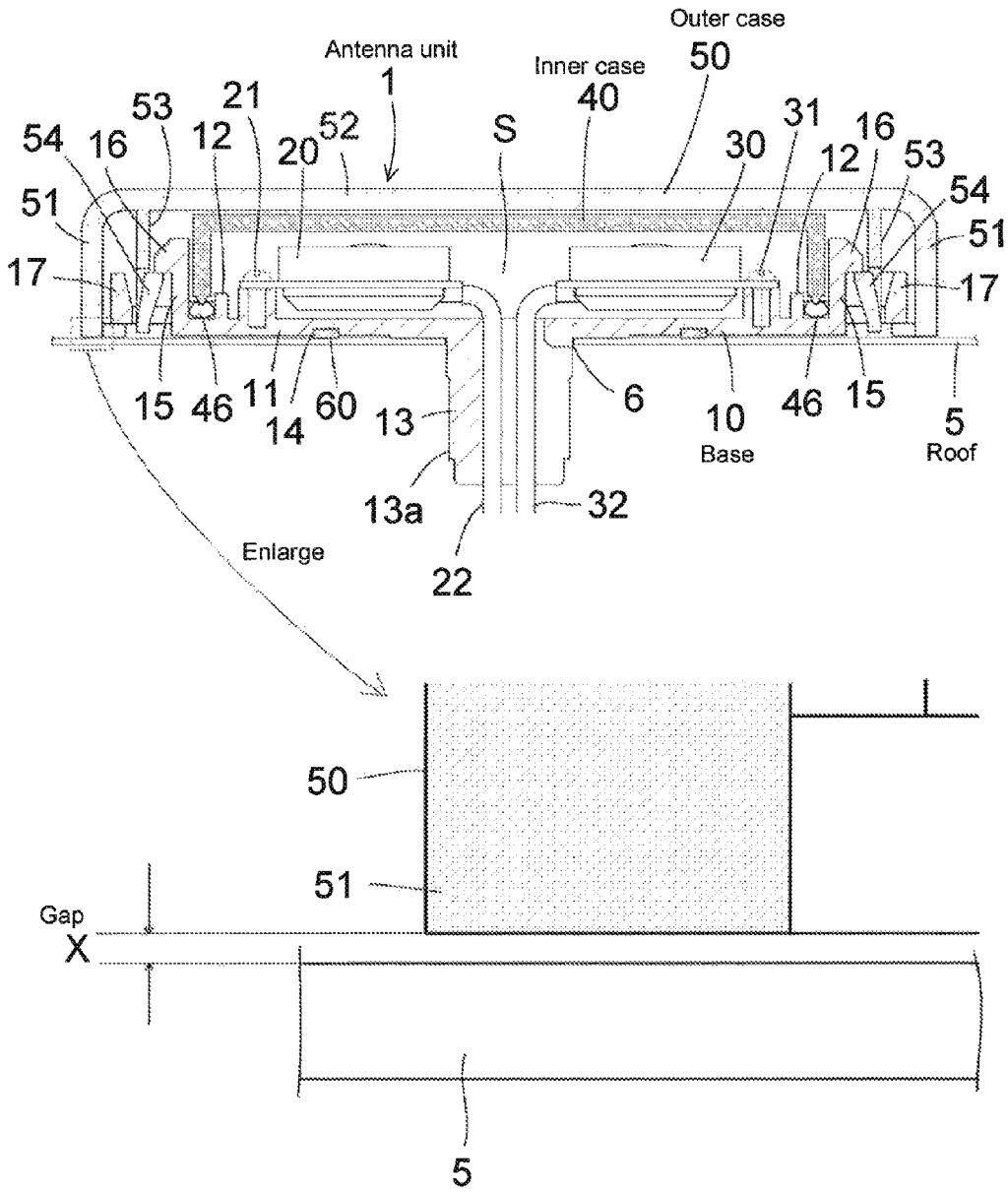
FIG. 1 is a partially enlarged front cross-sectional view of an embodiment of an antenna unit according to the present invention.

The invention will now be described based on the following embodiments which do not intend to limit the scope of the present invention but exemplify the invention. All of the features and the combinations thereof described in the embodiments are not necessarily essential to the invention.

In FIG. 1 to FIG. 7, an antenna unit 1 includes a base 10 made of aluminum die-casting, zinc die-casting, etc., antenna elements 20 and 30 disposed on the base 10, an inner case 40 fixed to the base 10 to cover the antenna elements 20 and 30 and, and an outer case 50 mounted on (fixed to) the base 10 to cover the inner case 40. The antenna unit 1 has a double case structure including the inner case 40 and the outer case 50.

The base 10 integrally has a rib 12 defining a portion of an antenna element disposition space S on the top surface side of a bottom surface portion 11 and a feeding cylindrical portion 13 projecting from an under surface center portion. The under surface of the bottom surface portion 11 has an annular groove 14 formed for disposing an O-ring 60 acting as a seal member so that the feeding cylindrical portion 13 is surrounded on the inside of the outer circumference.

The base 10 also integrally has, as a base-side fitting portion, an engaging protruding portion 16 at a tip of a standing portion 15 rising from the bottom surface portion 11 and integrally has a regulating portion 17 facing the standing portion 15.

Figure 3:
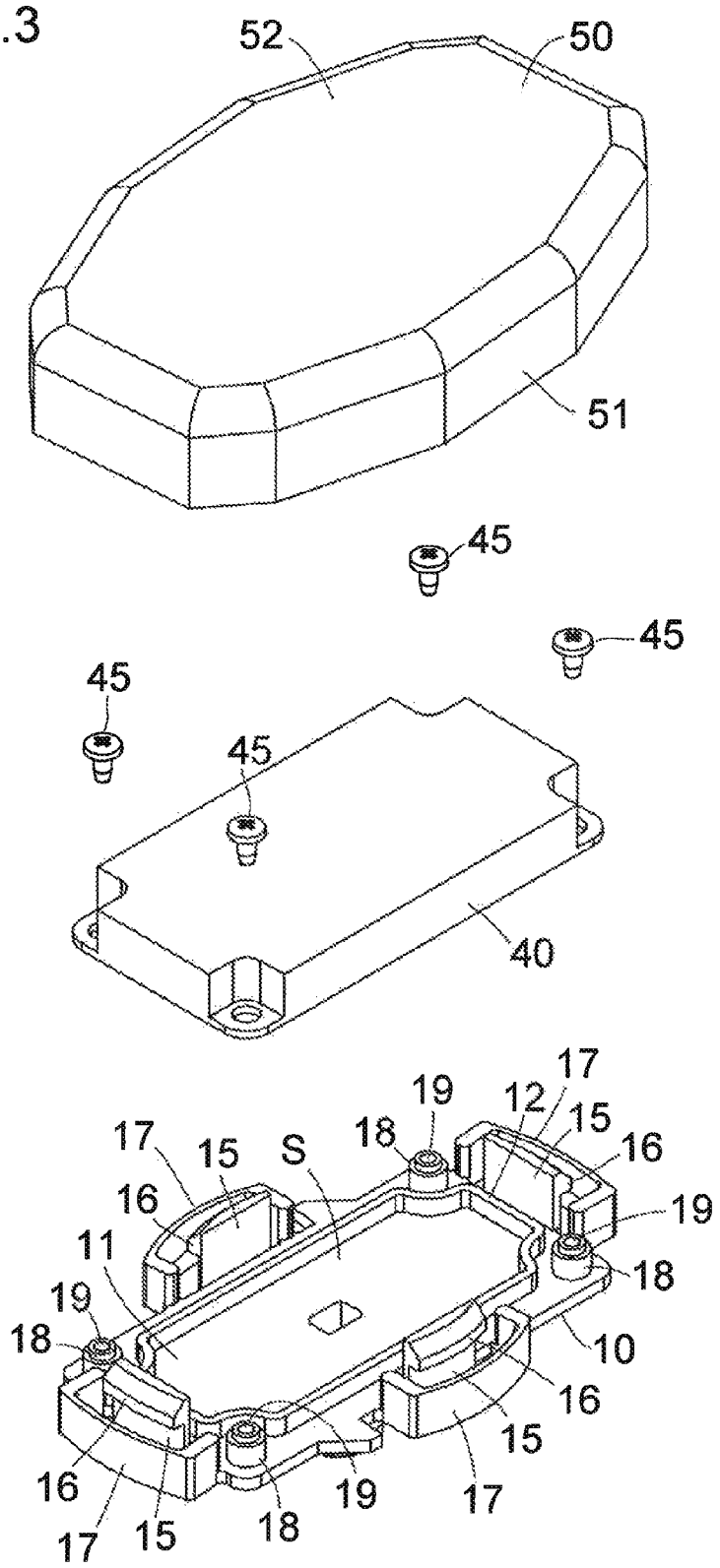
FIG. 3 is an exploded perspective view of a double case structure according to the embodiment.

As shown in FIG. 3, a protruding portion 18 is integrally formed on the upper side of the bottom surface portion 11 at a position outside the rib 12, and a boss 19 for a female screw is formed for attaching the inner case 40 to the protruding portion 18 (it is assumed that a self-tap screw is used as a screw 45 described later).

The antenna elements 20 and 30 are disposed in the antenna element disposition space S inside the rib 12. The antenna elements 20 and 30 are antenna elements including patch antennas, for example, and the antenna element 20 is for XM satellite radio while the antenna element 30 is for GPS. In the shown example, the antenna elements 20 and 30 are fixed to the base 10 by screws 21 and 31, and feeder lines 22 and 23 connected to the antenna elements 20 and 30 are pulled out through the inside of the feeding cylindrical portion 13 to the outside.

Figure 5:
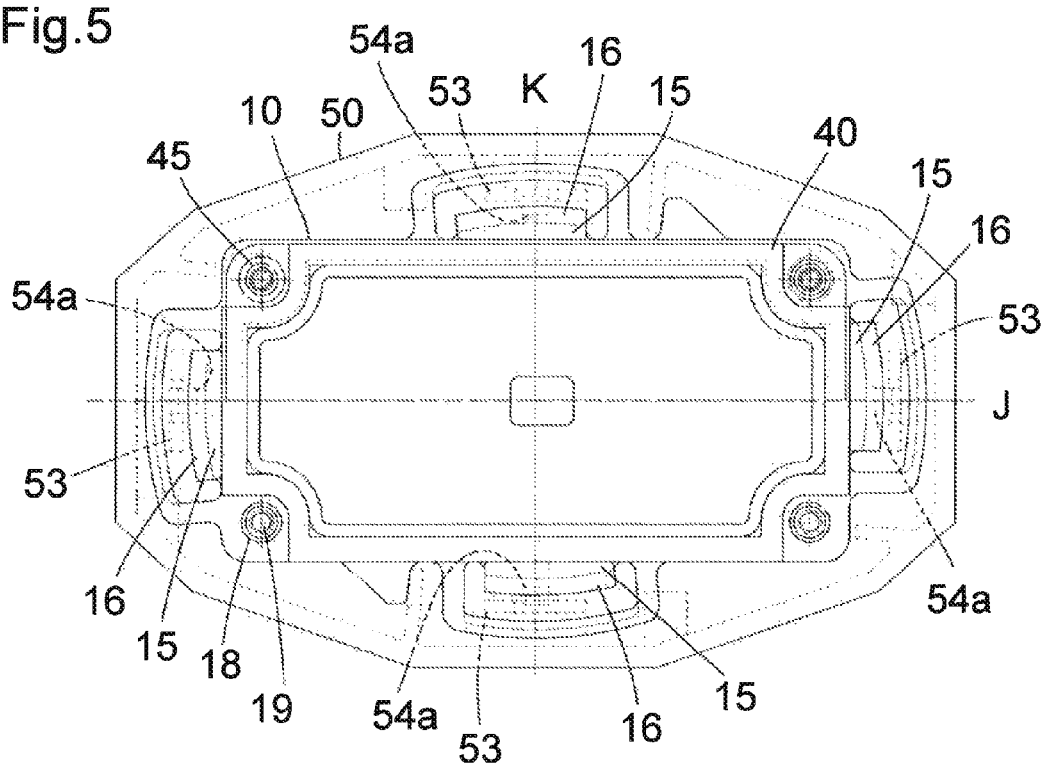
FIG. 5 is a plain view of the embodiment wherein a base and an inner case indicated by solid lines for convenience of description.

The inner case 40 is made of resin transmissible of radio waves and, after antenna elements 20 and 30 are attached to the base 10, the inner case 40 is fixed to the base 10 by the screws 45 of FIG. 3 and FIG. 5 (the screws 45 are screwed into the bosses 19 for female screws while cutting screw grooves) so as to cover the antenna elements 20 and 30. An O-ring 46 acting as a seal member is disposed on the bottom surface portion 11 of the base 10 to surround the outside of the rib 12 and the lower edge of the inner case 40 is pushed against the O-ring 46. That is, the inner case 40 is fixed to the base 10 with the O-ring 46 surrounding the antenna element disposition space S on the base 10 interposed therebetween so as to form a watertight space surrounded by the base 10 and the inner case 40.

Normally, the attachment to a vehicle body roof 5 acting as a mounted object is performed after the antenna elements 20 and 30 and the inner case 40 are attached to the base 10 (before mounting the outer case 50). The base 10 is attached by inserting the feeding cylindrical portion 13 into an attachment hole 6 disposed in the roof 5 and screwing a nut not shown to a male thread 13*a* formed on the outer circumference of the feeding cylindrical portion 13. At this time, the O-ring 60 disposed in the annular groove 14 surrounds the feeding cylindrical portion 13 and is interposed between the base 10 and the top surface of the roof 5 acting as the mounted surface, thereby ensuring the watertight seal around the attachment hole 6.

Figure 2:
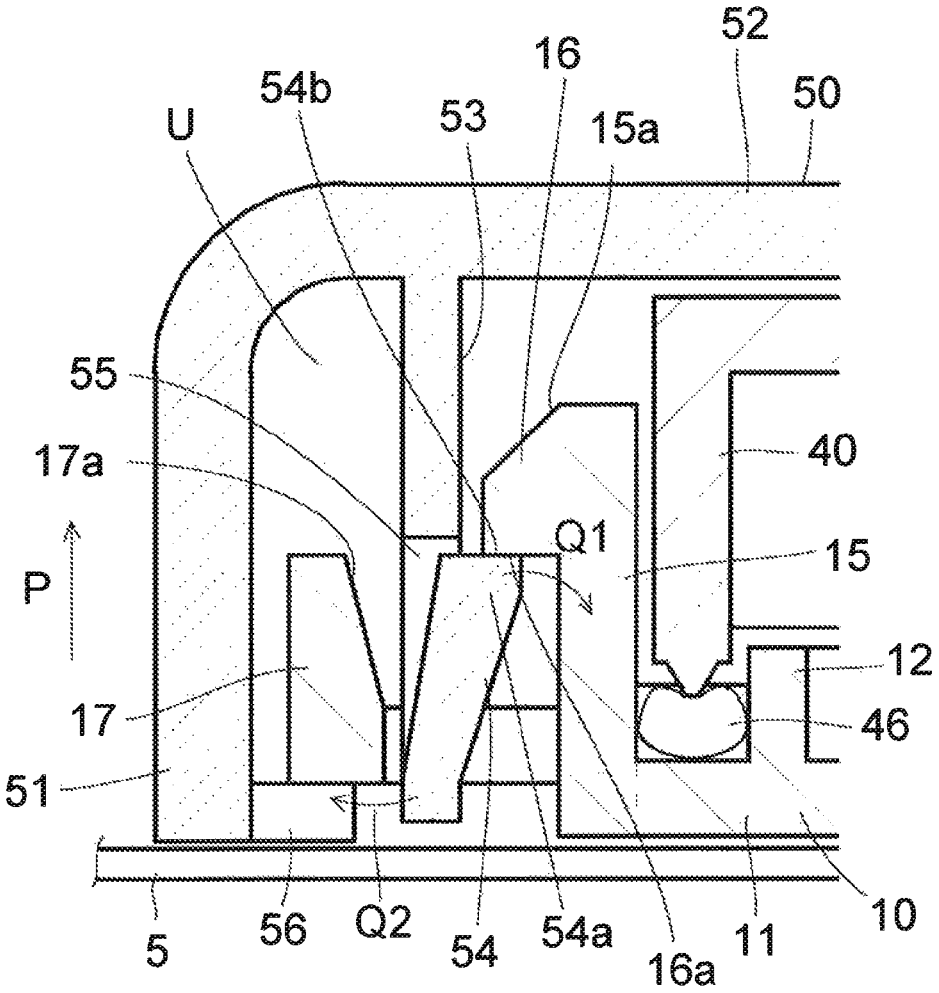
FIG. 2 is an enlarged cross-sectional view of details of a base-side fitting portion and an outer-case-side fitting portion according to the embodiment.

The outer case 50 is made of resin transmissible of radio waves, is painted in the same color as the vehicle body roof 5, and is variously designed depending on a car model. As shown in FIG. 2, the outer case 50 has a side surface portion 51 surrounding the outer edge of the base 10 and a ceiling portion 52, and integrally has a main piece portion 53 and a sub-piece portion 54 as an outer-case-side fitting portion. The main piece portion 53 and the sub-piece portion 54 are extending downward (hanging down) from a ceiling surface (inner wall surface) of the ceiling portion 52. The main piece portion 53 and the sub-piece portion 54 have flexibility. The main piece portion 53 is positioned on the inside of the inner wall surface of the side surface portion 51 across a space U so as to prevent external impact to the outer case 50 from being directly applied to the main piece portion 53.

Figure 4:
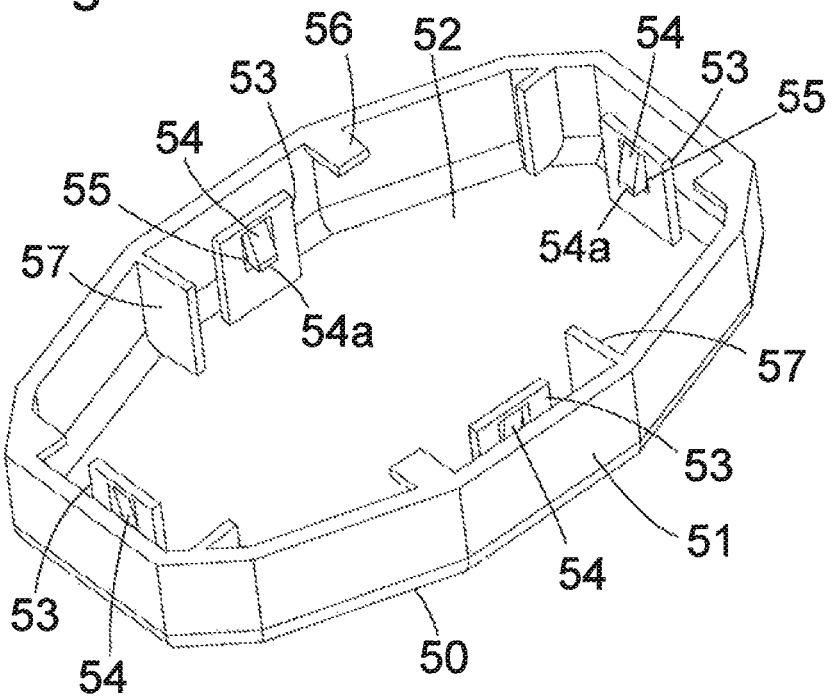
FIG. 4 is a perspective view of an outer case viewed from the under surface side according to the embodiment.

As shown in FIG. 2 and FIG. 4, the sub-piece portion 54 is formed inside an opening 55 disposed in the main piece portion 53, and is connected at a lower end to the main piece portion 53. The lower end acts as a supporting point when the sub-piece portion 54 is bent. An upper end of the sub-piece portion 54 has a greater thickness to form an engaging claw 54*a* protruding on the lateral side of the main piece portion 53 toward the engaging protruding portion 16 (to the inside).

On the other hand, the engaging protruding portion 16 formed at the tip of the standing portion 15 of the base 10 protrudes toward the engaging claw 54*a* (to the outside), and the regulating portion 17 faces the standing portion 15 with the main piece portion 53 and the sub-piece portion 54 interposed therebetween and is located at a position limiting the bending amount of the main piece portion 53. An upper part of the standing portion 15 and an upper part of the regulating portion 17 have respective taper surfaces 15*a* and 17*a* formed so that a thickness increasing toward the lower side. Both of the taper surfaces 15*a* and 17*a* face the main piece portion 53 to act as guiding surfaces so that the main piece portion 53 is smoothly inserted.

When the outer case 50 is attached to the base 10, as the main piece portion 53 acting as the outer-case-side fitting portion is inserted between the standing portion 15 and the regulating portion 17, the main piece portion 53 is guided by the taper surfaces 15*a* and 17*a* and the engaging claw 54*a* of the sub-piece portion 54 eventually engages with (fit to) the engaging protruding portion 16. In other words, the engaging claw 54*a* gets into the underside of the engaging protruding portion 16 and an upper end surface 54*b* of the engaging claw 54*a* is brought into contact with an under surface 16*a* of the engaging protruding portion 16 so that the engaging claw 54*a* is engaged and prevented from coming off.

In FIG. 2, if an external force is applied in a direction P of removing the outer case 50, the sub-piece portion 54 is bent in directions of arrows Q1 and Q2 and therefore is not pulled out unless the resin is broken. An excessive bending amount facilitating the pullout can be prevented by limiting a bending amount (displacement amount) of the main piece portion 53 with the regulating portion 17.

To prevent the uplift of the outer case 50 from the base 10 and sufficiently reduce (substantially eliminate) a gap between the lower edge of the outer case 50 and the roof 5, the outer case 50 has a plurality of projecting piece portions 56 having elasticity and extending inward from the lower edge of the inner wall surface of the side surface portion 51. FIG. 6 shows an example when the projecting piece portions 56 are disposed at four positions.

Figure 6A:
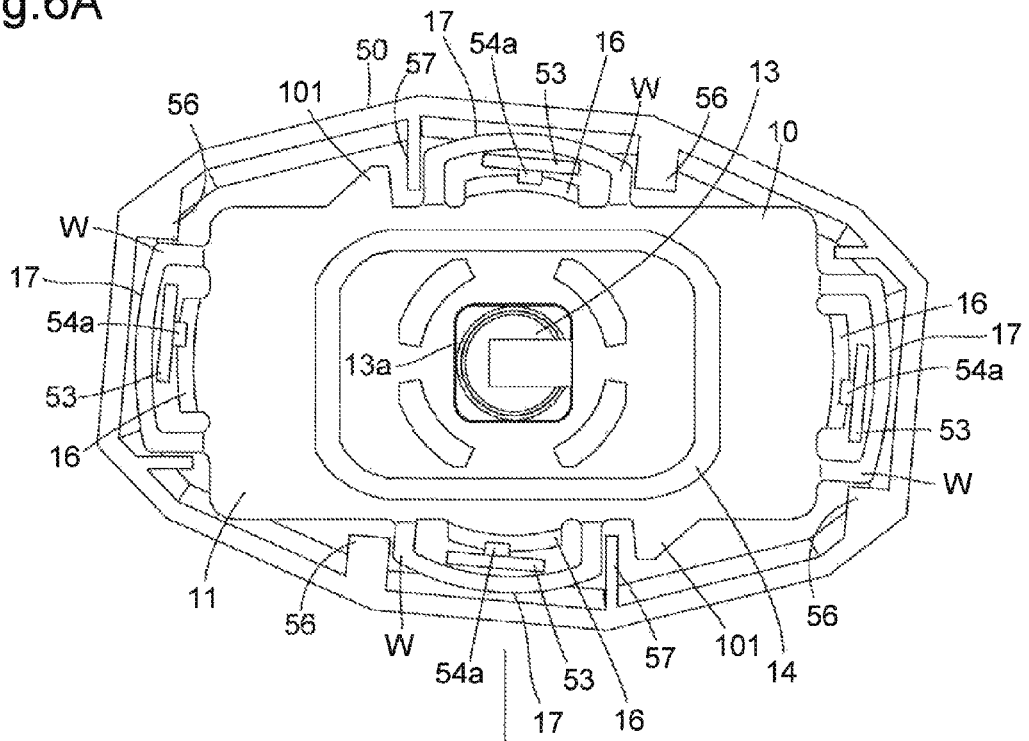
FIG. 6A is a bottom view of a state immediately after the outer case is fitted to and mounted on the base.
Figure 6B:
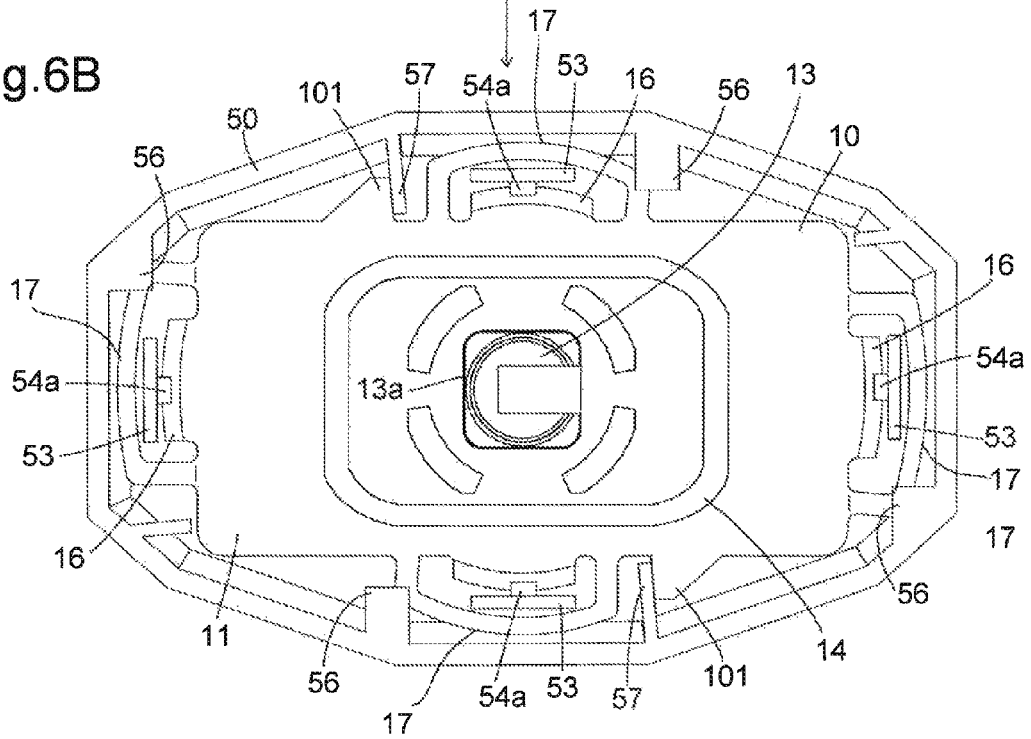
FIG. 6B is a bottom view of a state when the outer case is rotated (twisted) relative to the base to press a projecting piece portion of the outer case against the under surface side of the base.
Figure 7:
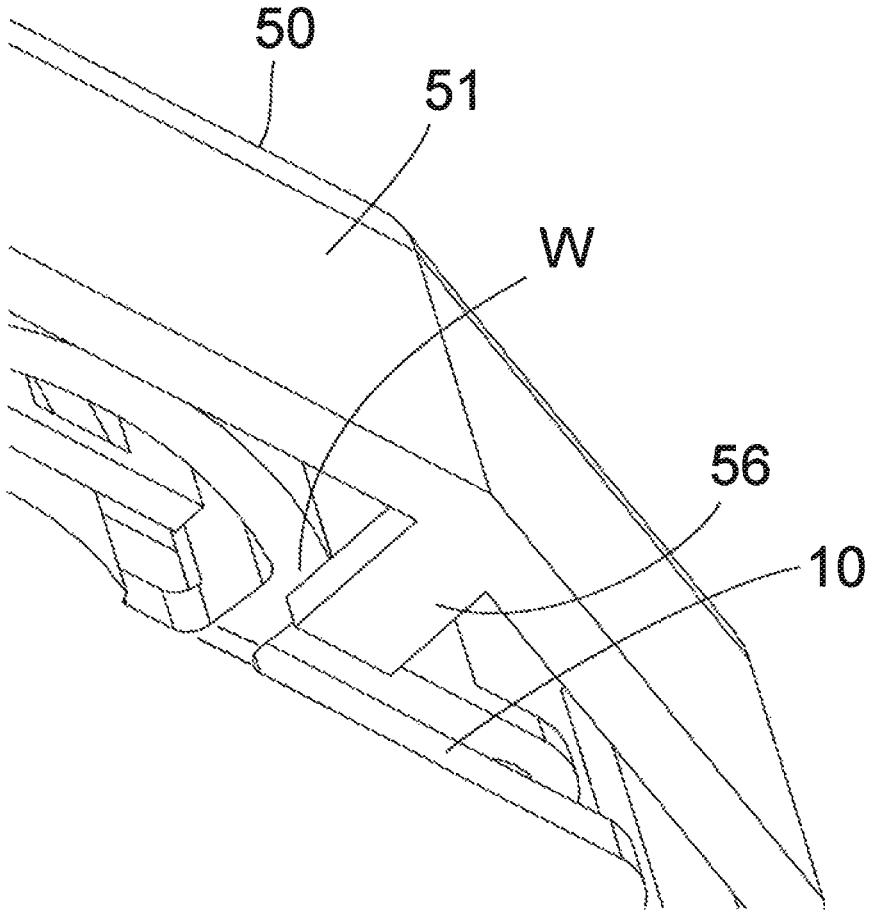
FIG. 7 is an enlarged perspective view of a state when the projecting piece portion of the outer case is pressed against the under surface side of the base according to the embodiment.

When the outer case 50 is attached to the base 10, the outer case 50 is mounted so that the projecting piece portions 56 are located at positions not interfering with the base 10 as shown in FIG. 6(A), and the outer case 50 is then rotated by a predetermined angle relative to the base 10 as shown in FIG. 6(B) to press the projecting piece portions 56 against under surface regions W of the base 10. The under surface regions W are corner portions of bottom surfaces of the regulating portions 17 extending from the bottom surface portion 11 and formed integrally with the base 10 to surround the standing portion 15. When the projecting piece portions 56 are pressed against the under surface regions W, a force is applied in the direction of pulling down the outer case 50 to the base 10 to sufficiently reduce (substantially eliminate) a gap between the outer case 50 and the top surface of the roof 5 acting as the mounted surface. A rotation amount of the outer case 50 is defined by stopper ribs 57 projecting inward from the inner wall surface of the side surface portion 51 of the outer case 50 coming into contact with stopper portions 101 formed on the outer edge of the base 10. The lowering of the outer case 50 due to pressing the projecting piece portions 56 against the under surface regions W is regulated by the ceiling portion 52 of the outer case 50 abutting on and supported by the top surface of the inner case 40, for example.

The under surface regions W of the base 10 coming into contact with the projecting piece portions 56 more preferably have taper surfaces inclining downward as the rotation amount (twisting amount) of the outer case 50 increases.

As shown in FIG. 5 etc., the base-side fitting portion (the standing portion 15 and the engaging protruding portion 16) and the outer-case-side fitting portion (the main piece portion 53 and the sub-piece portion 54) are disposed at each of two locations on a first straight line J as well as at each of two locations on a second straight line K orthogonal to the first straight line J. This configuration keeps the fitting portions fitted to each other at least at two or more locations even if the outer case 50 is distorted or deformed when an external force is applied. For example, if an external force in the direction of the straight line J is applied in the direction of laterally displacing the outer case 50, while the fitting between the base-side fitting portions and the outer-case-side fitting portions on the straight line J may become unstable, the fitting between the base-side fitting portions and the outer-case-side fitting portions is stably maintained at two locations on the straight line K orthogonal to the straight line J. Similarly, if an external force in the direction of the straight line K is applied in the direction of laterally displacing the outer case 50, the fitting between the base-side fitting portions and the outer-case-side fitting portions is stably maintained at two locations on the straight line J. If external forces clamping the outer case 50 are applied from the both sides in the directions along the straight line K, the forces expanding the side surface portion 51 to the outside are generated in the directions along the straight line J, and then the fitting between the base-side fitting portions and the outer-case-side fitting portions on the straight line J may become unstable, but the fitting between the base-side fitting portions and the outer-case-side fitting portions is stably maintained at two locations on the straight line K. Similarly, if external forces clamping the outer case 50 are applied from the both sides in the directions along the straight line J, the forces expanding the side surface portion 51 to the outside are generated in the directions along the straight line K, and then the fitting between the base-side fitting portions and the outer-case-side fitting portions on the straight line K may become unstable, but the fitting between the base-side fitting portions and the outer-case-side fitting portions is stably maintained at two locations on the straight line J.

According to the embodiment, the following effects are produced.

(1) Because of the configuration in which the outer case 50 acting as the exterior is directly attached to the base 10 to which the inner case 40 is attached, variation can be reduced in the gap between the outer case 50 and the top surface of the roof 5 acting as the mounted surface. In particular, assuming A is single base dimension tolerance, B is single inner case dimension tolerance, C is single outer case dimension tolerance, and X is gap dimension accumulated tolerance, while the gap dimension accumulated tolerance X is expressed by X=A+B+C in Patent Document 1 since the outer case is attached to the inner case, the gap dimension accumulated tolerance X is expressed by X=A+C in the embodiment of the present invention. That is, because of the absence of the single inner case dimension tolerance B, the accumulated tolerance X is reduced and a gap between the outer case 50 and the top surface of the roof 5 can substantially be eliminated or controlled to a negligible level.

(2) Since the outer case 50 can simply be fitted to the base 10, the outer case 50 can easily be mounted and, moreover, the outer case 50 can certainly be fitted to the base 10 and can be prevented from easily coming off due to vibration, shock, etc.

In particular, with regard to an external force removing the outer case 50 in the direction orthogonal to the base 10, since the main piece portion 53 and the sub-piece portion 54 connected at the lower end to the main piece portion 53 are formed as the outer-case-side fitting portion so that the upper part of the sub-piece portion 54 is defined as the engaging claw 54*a* as shown in FIG. 2, a structure is realized that is prevented from being bent and pulled out due to the external force. On the other hand, both Patent Documents 1 and 2 describe a simple claw structure, which easily comes off if a base portion of a claw is bent due to an external force.

With regard to an external force moving the outer case 50 in parallel with the base 10, as shown in FIG. 5, since the structure is established by disposing the base-side fitting portions (the standing portions 15 and the engaging protruding portions 16) and the outer-case-side fitting portions (the main piece portions 53 and the sub-piece portions 54) at both the two locations on the first straight line J and the two locations on the second straight line K orthogonal to the first straight line J, even if the outer case 50 is distorted or deformed when the external force is applied, the fitting portions can always be fitted to each other at two locations. In contrast, since engaging claws are disposed axisymmetrically relative to one straight line in Patent Document 1, the engaging claws tend to come off due to an external force orthogonal to the one straight line.

(3) The outer case 50 has a plurality of the projecting piece portions 56 extending inward from the lower edge of the inner wall surface of the side surface portion 51 and the projecting piece portions 56 can be pressed against the under surface side of the base 10 by rotating the outer case 50 relative to the base 10 by a predetermined angle. This structure can pull down the outer case 50 toward the base 10, prevent the uplift of the outer case 50 from the base 10 due to distortion, deformation, etc., of the outer case 50, and maintain a gap between the outer case 50 and the top surface of the roof 5 sufficiently small.

(4) Because of the double case structure in which the inner case 40 and the outer case 50 are mounted on the base 10, the inner components of the antenna unit may be used in common, and the outer case 50 may lastly be attached as an exterior component, while waterproof structure etc. are established by the base 10 and the inner case 40. In this case, only the outer cases 50 may be prepared in various types in accordance with a car model, paint color, etc.

Described above is an explanation based on the embodiment. The description of the embodiments is illustrative in nature and various variations in constituting elements and processes involved are possible. Those skilled in the art would readily appreciate that such variations are also within the scope of the present invention.

Although the both antenna elements 20 and 30 of the embodiment including antennas called patch antennas, the antenna elements are not limited thereto and may be other antennas for FM radio and digital terrestrial television. In this case, since the antenna shape is different from that acquired by using the patch antennas and is changed to a shape acquired by using helical antennas or planar antenna, the external appearances of the inner case and the outer case are accordingly changed.

Although a plurality of the projecting piece portions 56 having elasticity are disposed on the outer case 50 and pressed against the under surface side of the base 10 by a predetermined amount of rotation so as to prevent the uplift of the outer case 50 from the base 10 in the structure of the embodiment, the structure may be implemented so that the outer case 50 is slid relative to the base 10 to press the projecting piece portions 56 having elasticity against the under surface side of the base 10. However, this precludes the employment of the structure in which sets of the base-side fitting portions and the outer-case-side fitting portions are disposed on both straight lines orthogonal to each other as shown in FIG. 5 and sets of the base-side fitting portions and the outer-case-side fitting portions are disposed axisymmetrically relative to one straight line.

Instead of giving elasticity to the projecting piece portions 56, elastic members may be disposed between the projecting piece portions 56 and the under surface side of the base 10.

EXPLANATIONS OF LETTERS OR NUMERALS

1 Antenna unit
5 Vehicle body roof
10 Base
11 Bottom surface portion
12 Rib
13 Feeding cylindrical portion
14 Annular groove
15 Standing portion
15*a*, 17*a* Taper surface
16 Engaging protruding portion
17 Regulating portion
20, 30 Antenna element
40 Inner case
46, 60 O-ring
50 Outer case
53 Main piece portion
54 Sub-piece portion
54*a* Engaging claw
55 Opening
56 Projecting piece portion
S Antenna element disposition space

The invention claimed is:

1. An antenna unit for mounting on a vehicle roof, wherein the antenna unit comprises:
- a base for mounting on the vehicle roof and having integral base-side fitting portions that are an integral part of the base,
- an antenna element supported on the base,
- an inner case fixed to the base and covering the antenna element, and
- an outer case mounted on and directly attached to the base and covering the inner case, wherein
  - the outer case has a side surface portion surrounding an outer edge of the base, a ceiling portion joined to the side surface portion, integral outer-case-side fitting portions that are an integral part of the outer case, and an inner wall surface, and
  - the integral outer-case-side fitting portions of the outer case are positioned inside of and spaced from the side surface portion of the outer case, and are fitted to, engage, and directly contact with the integral base-side fitting portions of the base so that a gap between the outer case and the vehicle roof is negligible.

2. The antenna unit according to claim 1, wherein
- each of the integral base-side fitting portions of the base includes a bottom surface portion, a standing portion having a tip, and an engaging protruding portion at the tip of the standing portion, and the standing portion rises transverse to and from a bottom surface portion of the base,
- each of the integral outer-case-side fitting portions of the outer case has a main piece portion extending downward from and transverse to a ceiling wall surface of the outer case, and a sub-piece portion having upper and lower ends, and connected at the lower end to the main piece portion,
- the lower end acts as a supporting point when the sub-piece portion is bent,
- the upper end of the sub-piece portion has an engaging claw protruding toward a lateral side of the main piece portion, and
- the engaging claw is engaged by the engaging protruding portion.

3. The antenna unit according to claim 2, wherein the main piece portion has an opening and the sub-piece portion is located inside the opening in the main piece portion.

4. The antenna unit according to claim 3, wherein
- the base has a plurality of regulating portions respectively facing respective standing portions, with one of the integral outer-case-side fitting portions of the outer case interposed between each regulating portion and a corresponding standing portion, each regulating portion is located at a position limiting bending of a corresponding main piece portion, and each standing portion has an upper part, each regulating portion has an upper part, and the upper parts of one of the standing portions and of the corresponding regulating portion have respective tapering thicknesses and the thicknesses of the standing portions and of the regulating portions increase toward the base.

5. The antenna unit according to claim 3 including first and second pairs of each of the integral base-side fitting portions of the base and integral outer-case-side fitting portions of the outer case, wherein the first pairs of the integral base-side fitting portions of the base and the integral outer-case-side fitting portions of the outer case are disposed at respective locations, on a first straight line, the second pairs of the integral base-side fitting portions of the base and the integral outer-case-side fitting portions of the outer case are disposed at respective locations, on a second straight line, and the second straight line is orthogonal to the first straight line.

6. The antenna unit according to claim 3, wherein the outer case has a projecting piece portion extending inward from and transverse to the side surface portion, and the projecting piece portion presses against an under surface side of the base and, when the outer case is rotated relative to the base by a predetermined angle, the projecting pieces no longer presses against the under surface of the base for separating the outer case from the base.

7. The antenna unit according to claim 2, wherein the base has a plurality of regulating portions respectively facing respective standing portions, with one of the integral outer-case-side fitting portions of the outer case interposed between each regulating portion and a corresponding standing portion, each regulating portion is located at a position limiting bending of a corresponding main piece portion, and each standing portion has an upper part, each regulating portion has an upper part, and the upper parts of the standing portions and of the corresponding regulating portion have respective tapering thicknesses and the thicknesses of the standing portions and of the regulating portions increase toward the base.

8. The antenna unit according to claim 7 including first and second pairs of each of the integral base-side fitting portions of the base and integral outer-case-side fitting portions of the outer case, wherein the first pairs of the integral base-side fitting portions of the base and the integral outer-case-side fitting portions of the outer case are disposed at respective locations, on a first straight line, the second pairs of the integral base-side fitting portions of the base and the integral, outer-case-side fitting portions of the outer case are disposed at respective locations, on a second straight line, and the second straight line is orthogonal to the first straight line.

9. The antenna unit according to claim 7, wherein the outer case has a projecting piece portion extending inward from and transverse to the side surface portion, and the projecting piece portion presses against an under surface side of the base and, when the outer case is rotated relative to the base by a predetermined angle, the projecting pieces no longer presses against the under surface of the base for separating the outer case from the base.

10. The antenna unit according to claim 2 including first and second pairs of each of the integral base-side fitting portions of the base and integral outer-case-side fitting portions of the outer case, wherein the first pairs of the integral base-side fitting portions of the base and the integral outer-case-side fitting portions of the outer case are disposed at respective locations, on a first straight line, the second pairs of the integral base-side fitting portions of the base and the integral outer-case-side fitting portions of the outer case are disposed at respective locations, on a second straight line, and the second straight line is orthogonal to the first straight line.

11. The antenna unit according to claim 2, wherein the outer case has a projecting piece portion extending inward from and transverse to the side surface portion, and the projecting piece portion presses against an under surface side of the base and, when the outer case is rotated relative to the base by a predetermined angle, the projecting pieces no longer presses against the under surface of the base for separating the outer case from the base.

12. The antenna unit according to claim 1 including first and second pairs of each of the integral base-side fitting portions of the base and integral outer-case-side fitting portions of the outer case, wherein the first pairs of the integral base-side fitting portions of the base and the integral outer-case-side fitting portions of the outer case are disposed at respective locations, on a first straight line, the second pairs of the integral base-side fitting portions of the base and the integral outer-case-side fitting portions of the outer case are disposed at respective locations, on a second straight line, and the second straight line is orthogonal to the first straight line.

13. The antenna unit according to claim 12, wherein the outer case has a projecting piece portion extending inward from and transverse to the side surface portion, and the projecting piece portion presses against an under surface side of the base and, when the outer case is rotated relative to the base by a predetermined angle, the projecting pieces no longer presses against the under surface of the base for separating the outer case from the base.

14. The antenna unit according to claim 1, wherein the outer case has a projecting piece portion extending inward from and transverse to the side surface portion, and the projecting piece portion presses against an under surface side of the base and, when the outer case is rotated relative to the base by a predetermined angle, the projecting pieces no longer presses against the under surface of the base for separating the outer case from the base.

15. The antenna unit according to claim 1 further including a seal member, wherein the base has a feeding cylindrical portion projecting from an under surface of the base, the base is fixed to the vehicle roof, and the seal member is interposed between the base and the vehicle roof and surrounds the feeding cylindrical portion.

16. The antenna unit according to claim 1 further including a seal member, wherein the inner case is fixed to the base and the seal member is interposed between the base and the inner case and surrounds the antenna element that is supported on the base.

17. The antenna unit according to claim 16, wherein the seal member is located between the antenna element and the base-side fitting portions of the base.

18. The antenna unit according to claim 1, wherein the integral base-side fitting portions of the base project outwardly from and transverse to the base and are disposed outward of the antenna element, the integral outer-case-side fitting portions of the outer case project from the ceiling portion of the outer case, and the integral outer-case-side fitting portions of the outer case and the integral base-side fitting portions of the base hold the outer case to the base.

* * * * *